US006454319B1

(12) United States Patent
Dischler

(10) Patent No.: US 6,454,319 B1
(45) Date of Patent: Sep. 24, 2002

(54) FRICTIVE FLUID TREATMENT AND METHOD OF APPLICATION FOR SHOELACES

(75) Inventor: Louis Dischler, Spartanburg, SC (US)

(73) Assignee: Delphi Oracle Corp., Spartanburg, SC (US)

( * ) Notice: Subject to any disclaimer, the term of this patent is extended or adjusted under 35 U.S.C. 154(b) by 0 days.

(21) Appl. No.: 09/860,402

(22) Filed: May 18, 2001

(51) Int. Cl.[7] ..... B65H 69/04

(52) U.S. Cl. ..... 289/18.1; 427/180; 427/372.2; 427/445

(58) Field of Search ..... 427/180, 445, 427/372.2, 397.7; 289/1.2, 1.5, 18.1; 36/1, 98, 59 D; 223/113, 120

(56) References Cited

U.S. PATENT DOCUMENTS

| | | | | |
|---|---|---|---|---|
| 4,780,936 A | | 11/1988 | Brecher | |
| 4,927,749 A | | 5/1990 | Dorn | |
| 5,272,796 A | | 12/1993 | Nichols | |
| 5,673,546 A | | 10/1997 | Abraham et al. | |
| 5,920,970 A | * | 7/1999 | Coblentz | 2/270 |
| 6,051,672 A | | 4/2000 | Burns et al. | |
| 6,212,743 B1 | | 4/2001 | Cohen | |

* cited by examiner

*Primary Examiner*—Shrive P. Beck
*Assistant Examiner*—Rebecca A. Blanton

(57) ABSTRACT

The present invention relates to a method and frictive fluid composition for application to a shoelace knot, whereby the shoelace becomes more resistant to untying. The frictive fluid contains a volatile solvent and a frictive powder.

22 Claims, 3 Drawing Sheets

FRICTIVE FLUID TREATMENT AND METHOD OF APPLICATION FOR SHOELACES

FIELD OF THE INVENTION

The present invention generally relates to lace for footwear, and more particularly to methods for treating shoelace with a frictive fluid whereby the holding power of a shoelace knot is increased, and also to the composition of the frictive fluid.

BACKGROUND OF THE INVENTION

The major purpose for lace used in footwear is to adjust the size of the shoe to snugly fit the foot, and also to allow rapid shoeing and unshoeing of the foot. Most commonly, a bowknot is used to prevent the lace from loosening. The frictional characteristics of the lace surface play an important role in the functionality of the lace. With high lace to eyelet friction, it will be more difficult to initially lace the shoe, and more difficult to loosen the laces when removing the shoe. With low lace to lace friction, on the other hand, a bowknot may repeatedly become untied through the course of a day. This can be more than simply annoying if, for instance, one is carrying a heavy load, or running a marathon. Many mechanical devices and special shoelaces have been devised to solve this problem. These approaches suffer from a number of deficiencies, but a deficiency common to all is that the aesthetic of the shoe is altered, almost always in a negative direction. As the lace is one of the most visible portions of the shoe, replacing it with another lace designed for functionality will have limited appeal, and replacing or accessorizing the lace with a mechanical locking device will appeal only to the desperate. Such laces and mechanical locks are taught in U.S. Pat. No. 6,212,743 to Cohen, U.S. Pat. No. 5,272,796 to Nichols, U.S. Pat. No. 4,780,936 to Brecher, and U.S. Pat. No. 5,673,546 to Abraham et al. None of these lace systems have addressed the concurrent problems of assuring that the laces easily slide through the eyelets or holes provided for them, resisting knot loosening, and maintaining the aesthetics of the lace or footwear/lace combination.

SUMMARY OF THE INVENTION

The present invention provides a method for altering the self-frictional characteristics under compression of at least one free lace end of an article of footwear, so that a bow knot subsequently tied has greater resistance to loosening. As a preferred embodiment, the knot is tied first and a fluid comprising a frictive agent is applied at least to the tied knot and allowed to dry. The present invention also provides a frictive fluid composition that comprises a frictive powder. The frictive powder preferably is colorless and has low relative opacity, preferable less than 10, more preferably less than 5, and most preferably less than 1, so as to allow its use with minimum appearance change of the lace, especially colored or black lace. The frictive fluid preferably has a viscosity of less than 1000 cP, and more preferably less than 100 cP, and most preferably less than 50 cP, so as to allow the penetration of the frictive fluid into the lace, and to avoid build up on and resultant discoloration of the lace surface. A preferred frictive powder comprises silica, especially amorphous silica. The frictive powder must produce a breakaway force ratio (BFR), defined below, that is greater than one, more preferably at least 1.25, and most preferably at least 1.5. It is preferred for that the characteristic primary particle size is less than 100 nm, and preferably less than 50 nm.

It is an object of the present invention, therefore, to provide a method of lace treatment for increasing the breakaway force ratio (BFR) of a shoelace knot.

It is another object of at least one embodiment of the invention to provide a method for application of a frictive fluid to a lace of an article of footwear.

It is another object of at least one embodiment of the invention to provide a frictive fluid composition that does not substantially change the appearance of a shoelace.

BRIEF DESCRIPTION OF THE DRAWINGS

The above as well as other objects of the invention will become more apparent from the following detailed description of the preferred embodiments of the invention, when taken together with the accompanying drawings in which.

DETAILED DESCRIPTION OF THE PRESENTLY PREFERRED EMBODIMENTS

The drawings constitute a part of this specification and include exemplary embodiments to the invention. It is to be understood that in some instances various features of the invention may be shown in an exaggerated or enlarged aspect to facilitate an understanding of the invention. Specific details disclosed herein are not to be interpreted as limiting, but rather as a basis for the claims and as a representative basis for teaching one skilled in the art to employ the present invention in any structure or manner.

Special terminology used herein is defined as follows. The "knot plane" is the plane that incorporates the tongue (or equivalent) of the shoe in the immediate vicinity of the knot. Generally, the lace crossover of a bowknot will lie just above the knot plane, with the knot itself lying above the crossover, so that the structure of the bowknot is normal to the knot plane. The phrase "breakaway force" is defined as the maximum force required on a single lace end to pull the first centimeter of lace through a bowknot. The force (in units of gram-force) is directed normal to the knot plane. An average of several tests (usually 5) is used to reduce random variations. The abbreviation "BFR" refers to "breakaway force ratio", which is the breakaway force for the treated lace divided by the breakaway force for otherwise identical untreated lace. (Untreated lace has a BFR of one.) Herein, the BFR is always an average of five measurements unless otherwise specified. A BFR of 1.0 or less indicates that there was no improvement. The phrase "frictive powder" is defined as a powder that increases the breakaway force when applied to the knot, or to the lace surface that is subsequently knotted. The phrase "frictive fluid" is a frictive powder dispersion or slurry in a liquid. "Lace self-friction" refers to the friction characteristics of a lace contacting an identical lace with substantially identical surface treatment, while "lace to lace friction" refers to the frictional characteristics of a lace segment contacting an identical lace segment, where the surface treatments of the two lace segments may vary. "Knot" refers to a self-interlaced structure joining two lace segments, wherein there are compressive forces between the lace segments. "Bowknot" refers to a knot having loops extending from it. "Crossover" is the intertwining of two lace segments used as the first part of a bowknot.

Figure 1:
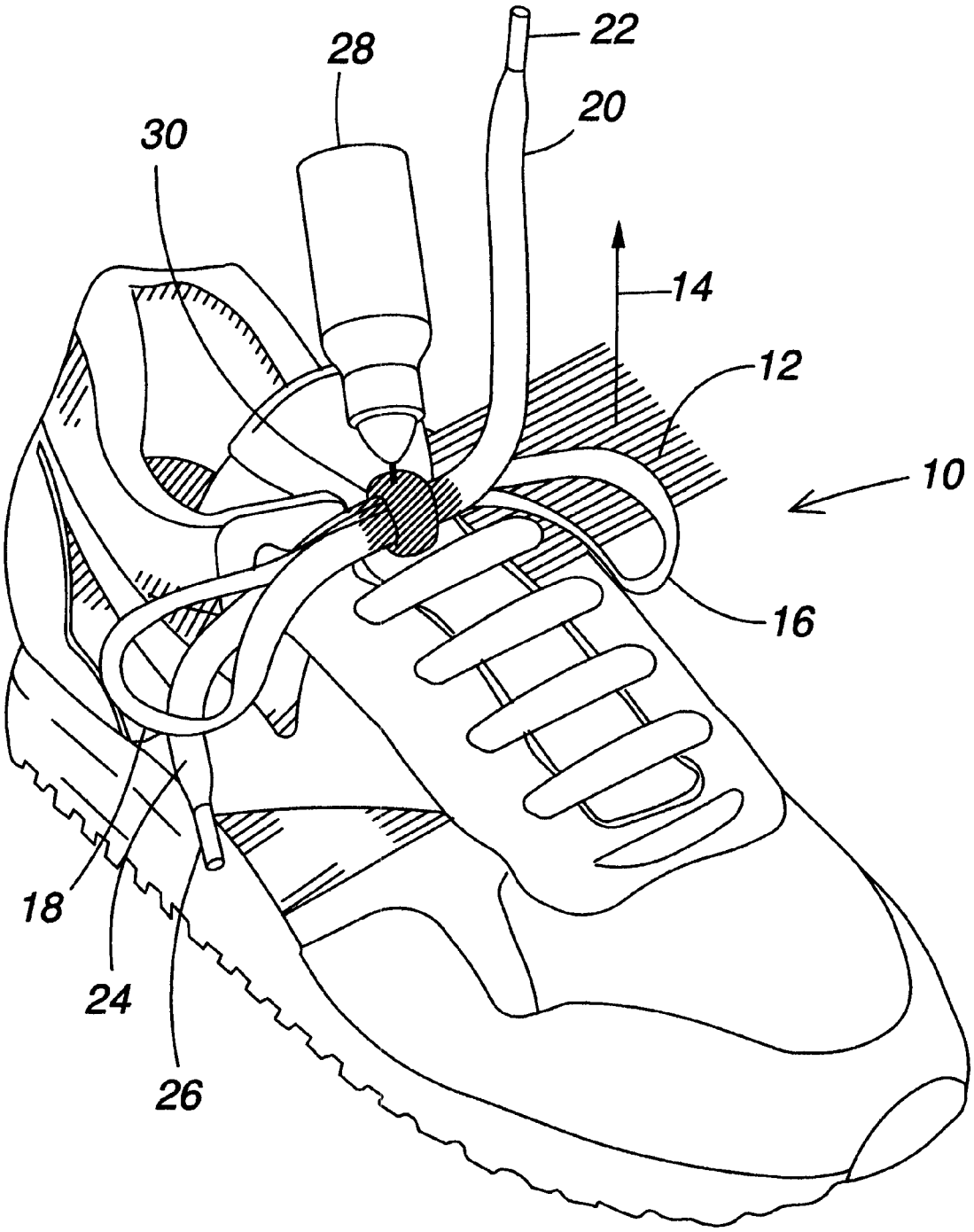
FIG. 1 is a perspective view of a running shoe having a knot in the act of being treated with a frictive fluid according to one embodiment of the invention.

Referring now to the drawings wherein like numerals refer to like parts, FIG. 1 illustrates a running shoe 10 having a lace threaded through eyelets. The knot plane is shown as a shaded area 12, with the perpendicular direction illustrated by arrow 14. The lace has a first free end 20 and a second free end 24, first loop 16 and second loop 18, first terminus 22 and second terminus 26, and knot 30. Squeeze bottle 28 is shown in the act of applying a frictive fluid to knot 30, whereby the knot 30 and some of the adjoining lace portions are coated by and adsorb the fluid. The knot 30 may be treated in the manner shown, however, it is preferred that the wearer's foot, or alternatively, a foot form be present in the shoe before the lace is knotted, to insure that the knot is tied in its preferred operational position on the lace, so that the proper portion of the lace is treated. In another embodiment, at least one free end of the lace is treated prior to knotting, so that after tying the knot, the BFR is greater than 1, preferably greater than 1.25, and most preferably greater than 1.5.

Figure 2:
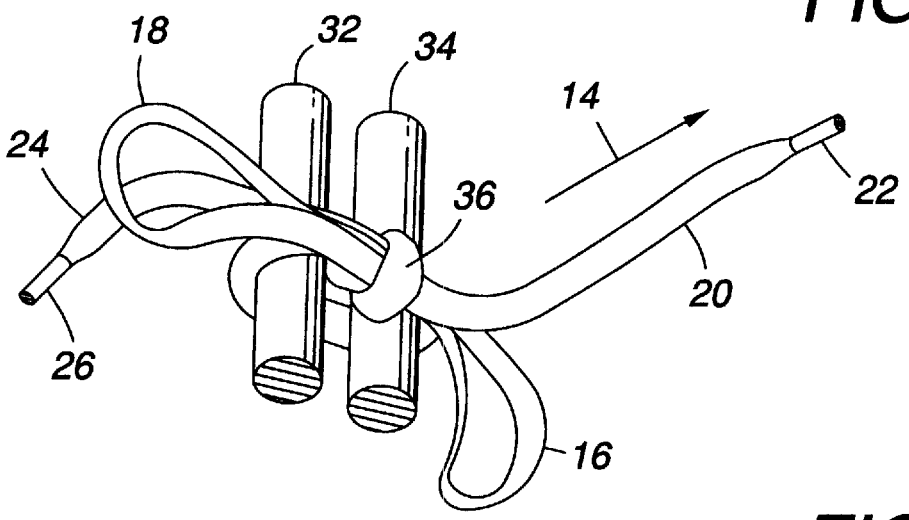
FIG. 2 is a perspective view of a test rig for determining the BFR of lace treated according to embodiments of the invention.

In order to measure the BFR, the free end 20 could be pulled in direction 14 of FIG. 1, however, the arrangement shown in FIG. 2 is preferred for this purpose, as it eliminates any random effects contributed by the shoe. In FIG. 2, the shoe is replaced with parallel bars 32, 34. The bars 32, 34 are 12 mm in diameter, and the axes are spaced apart by 25 mm. The plane containing the axes of the parallel bars 32, 34 is taken as the knot plane, and force is applied to the free end 20 in the direction 14, which is perpendicular to the knot plane, to determine the BFR. The bars 32, 34 are mounted in this spaced fashion to an electronic scale (not shown). To determine the BFR, five tie/untie cycles of the untreated bowknot are performed (with the bowknot completely untied each time), with the maximum force recorded as the first one cm of free end 20 slips through the knot 36. Five such tests are made and then averaged. One ml of a frictive fluid is then applied to the knot 36 and dried. Five tests are performed in the same fashion and averaged. The ratio of the treated average divided by the untreated average is the BFR for the particular lace used.

Figure 3:
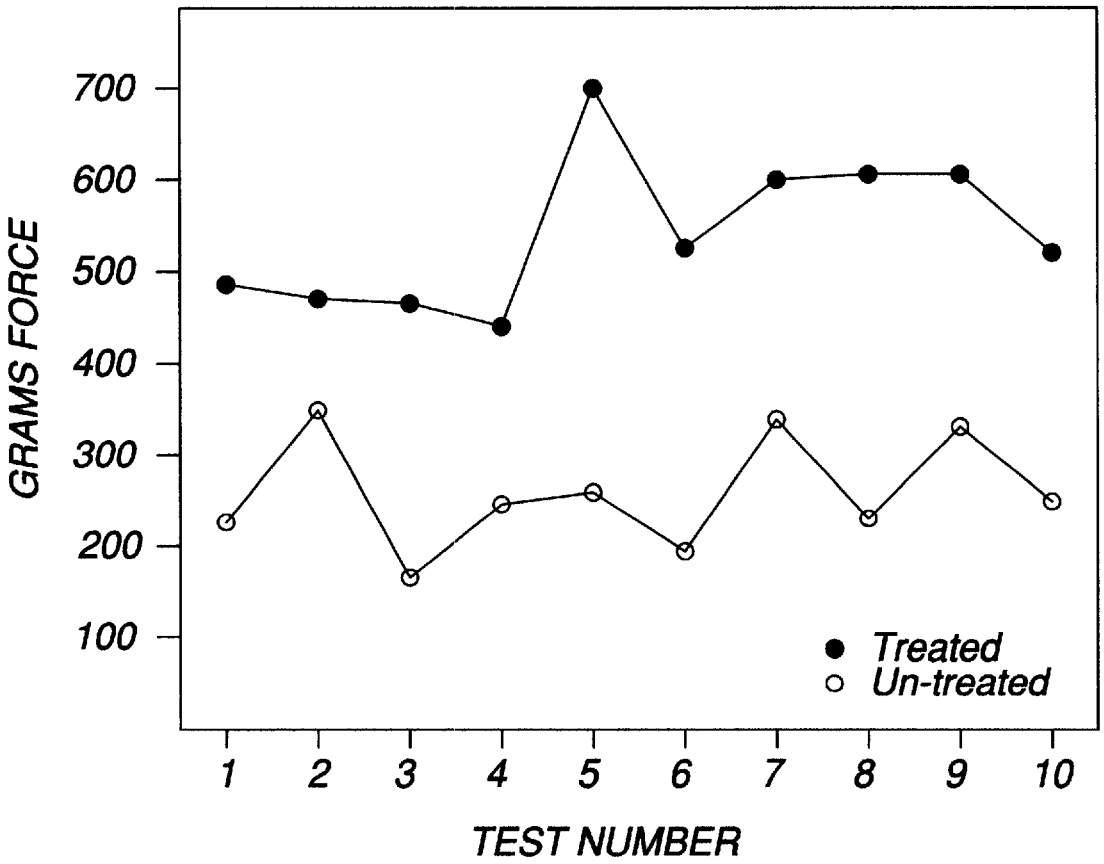
FIG. 3 is plot of the breakaway force required as treated and untreated lace are repeatedly tied and untied.

Turning now to FIG. 3, the effect of repeated tie/untie cycles (tests 1 through 10) is shown graphically. Ten samples of filament polyester lace having a flat cross-section, with a width of about 58 mm and a thickness of about 0.6 mm, were tied with bowknots using the test arrangement shown in FIG. 2. The lower curve traces the maximum force requirement for loosening the knots for the untreated lace, with each data point representing the average result for five laces. The upper curve traces the maximum force requirement for loosening the knots treated with 1 ml of frictive fluid each and allowed to air dry prior to test 1, with each data point also representing the average result for five laces. The treated lace requires more force than the untreated through all 10 tests, with an overall BFR of 2.1.

Figure 4:
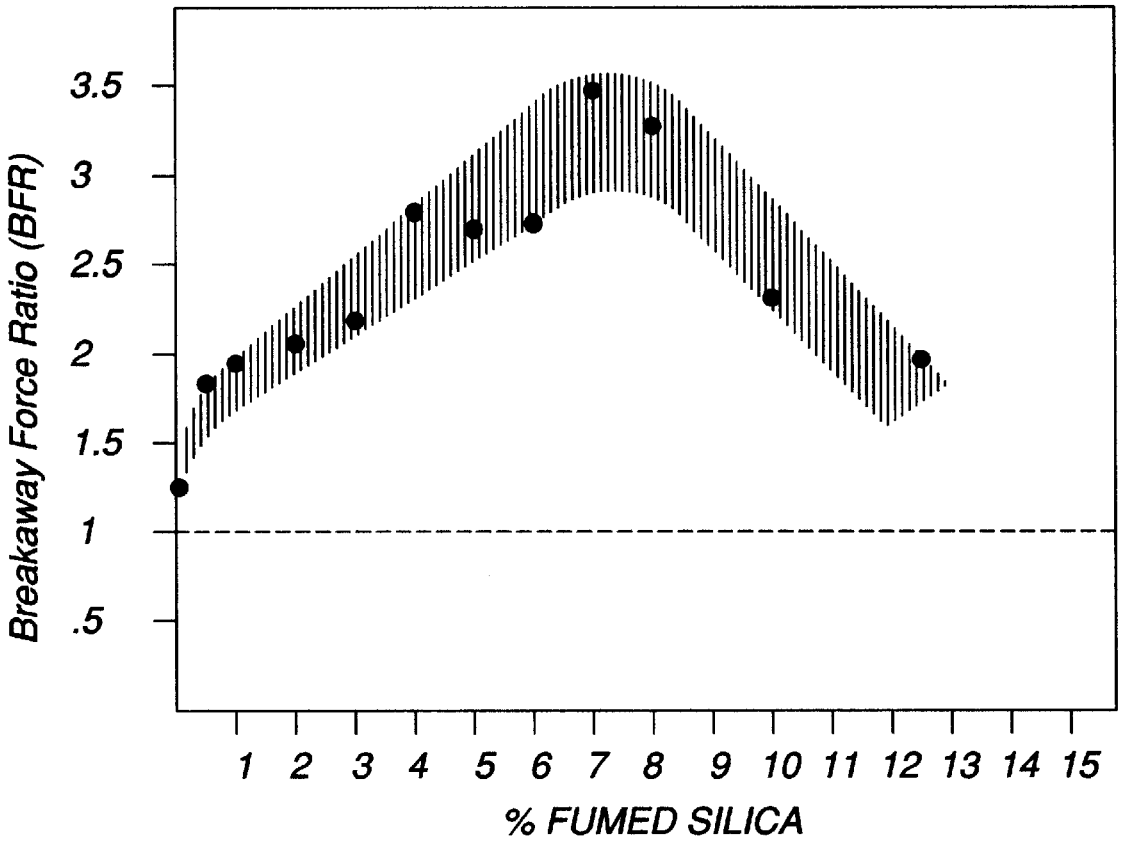
FIG. 4 is a plot of the BFR against the percent concentration of fumed silica in a frictive fluid composition.

In FIG. 4, the effect of concentration on the BFR is shown for fumed silica (FS). The BFR ranges from 1.25 for a concentration of 0.05% to a maximum of 3.47 at a concentration of 7%. The solvent used for this trial was a 25/75 mix of acetone and isopropanol, wherein the isopropanol contained 9% water. A 65/35 polyester/cotton cord was used, having a round cross-section with a diameter of 3.2 mm. Five tie/untie cycles of bowknots were averaged for each BFR result reported, using the test protocol discussed with reference to FIG. 2. The data from the plot is reproduced below:

| % FS | BFR |
|---|---|
| 0.05 | 1.25 |
| 0.5 | 1.84 |
| 1 | 1.95 |
| 2 | 2.06 |
| 3 | 2.18 |
| 4 | 2.79 |
| 5 | 2.70 |
| 6 | 2.73 |
| 7 | 3.47 |
| 8 | 3.27 |
| 10 | 2.31 |
| 12.5 | 1.97 |

The frictive fluid preferably comprises powder in the amounts ranging between 0.05% and 50% by weight, more preferably ranging between 0.1% and 25%, and most preferably ranging between 0.5% and 10%.

For maximum applicability, it is preferred that the frictive powder meet several criteria. First, the powder should create a frictive effect when compressed between two lace surfaces comprising the knot. Second, the self-frictional enhancement should last for at least several tie/untie cycles. Third, the powder should have low opacity, particularly for colored lace. And fourth, the powder should be easily dispersed so that it may be applied as a frictive fluid. One exemplary class of powders meeting these criteria is amorphous silica.

Both crystalline and amorphous silicas are commonly available. Of the amorphous silicas there are those of natural origin such as diatomaceous earth (DE), and synthetic varieties such as precipitated silica, colloidal silica, fumed silica (FS), and silica fume. Synthetic amorphous silica is generally prepared by vapor-phase hydrolysis, precipitation, polymerization, or any other appropriate process. The frictive agent of the present invention preferably comprises such amorphous silicas. However, other powders having characteristic primary particle mean value sizes ranging from 1 to 100 nm may be used (nanoparticles). Such powders may be produced by the methods described above, or by any other method, for instance, reverse micelle synthesis. Useful powders may comprise single oxides (e.g., cerium, zinc, or tin oxide), multi-cation oxides, carbonates (e.g., magnesium or calcium carbonate), halides, polymers, or any other material that in nanoparticulate form produces a BFR of greater than 1, more preferably greater than 1.25, and most preferably greater than 1.5.

So that colored lace may be treated to increase the BFR without degrading the appearance of the lace, the pigmenting power of the frictive powder is ideally low. The powder is therefore preferably colorless, or substantially so, and preferably has a relative opacity of less that 10, more preferably less than five, and most preferably less than one. Relative opacity is a measure of the ability of a substance to hide a surface behind and in contact with it. This is expressed as a ratio of the reflectance factor when the material is backed with a standard black surface, to the reflectance factor when backed by a standard black surface. Generally, powders with low relative opacity also have a low refractive index, while powders with high opacity have also have a high refractive index, as well a particle size chosen for maximum scattering power. For example, a rutile type $TiO_2$ powder having characteristic diameters in the range of 150 to 300 nm has a refractive index of 2.76, and a relative opacity of 100, while anatase type $TiO_2$, with a refractive index of 2.55, has a relative opacity of 81. Pigment grade antimony oxide powder has a refractive index of 2.2 and a relative opacity of 43. Pigment grade zinc oxide has a refractive index of about 2.0 and a relative opacity of 26. By comparison, calcium carbonate has a refractive index of 1.65 and a relative opacity of 2.8, and fumed silica has a refractive index of about 1.45 and a relative opacity of about 0.4, or 250 times less than rutile $TiO_2$ powder. Therefore, while $TiO_2$ powder, although colorless, would substantially alter the appearance of colored lace, fumed silica (and also precipitated silica, colloidal silica, and silica fume, and other nanoparticulate powders) would have minimum visual impact on either white or colored lace. As opacity falls off rapidly for particle sizes of less than 100 nm, particles smaller than 100 nm are preferred. The primary particle size of synthetic amorphous silicas is much small than this: typically, 1 to 2 nm for precipitated silica, and 10 to 20 nm for fumed silica. For highest lace to lace friction, it is preferred that the particles (which may be comprised of smaller primary particles) are prolate, bladed, equant, or more preferably, irregular in shape.

Synthetic amorphous silica is often used as a rheological modifier. Gels and pastes may be compounded with the addition of relatively small amounts in the appropriate solvent system. In the instant invention, it is desirable to maintain a relatively low viscosity so that the frictive fluid may easily penetrate both the knot and the lace itself, depositing frictive powder within the lace that then serves as a reservoir against loss of frictive powder from the surface of the lace during use. In addition, the impact on colored lace is minimized when the frictive fluid can penetrate the lace, so as not to deposit excess powder on the lace surface. It is preferred that the viscosity of the frictive fluid be less than 1000 cP, and more preferably less than 100 cP at ambient conditions. Furthermore, the frictive fluid should readily wet the lace.

Frictive powders having hydrophilic, hydrophobic, oleophilic or mixed properties may be used, as well as combinations thereof One method of producing hydrophobic silica is to graft silane or organosilane groups to the particle surfaces. Hydrophobicity is believed to be of advantage in the instant invention for wet performance. Any other chemical modification of the silica (or other frictive powder) by any process may also be used within the scope of the invention, including grafting of hydrophilic groups, so long as the BFR remains greater than one, more preferably greater than 1.25, and most preferably greater than 1.5. By way of example only, the preparation of silica having grafted hydrophobic groups is taught in U.S. Pat. No. 6,051,672 to Bums, et al., and the preparation of silica having hydrophilic groups is taught in U.S. Pat. No. 4,927,749, to Dorn. The teachings of these patents are incorporated herein by reference. Similarly, the frictive fluid may comprise other components, e.g., water repellents, fragrances, extenders, viscosity modifiers, surfactants, antimicrobials, pH modifiers, etc., so long as the BFR remains greater than one, more preferably greater than 1.25, and most preferably greater than 1.5.

Solvents for dispersing the frictive powder may comprise ketones, alcohols, hydrocarbons, water, or any other appropriate fluid. Appropriate fluids would adequately disperse the powder within the preferred viscosity range, would be safe to use by the consumer, and would not damage the lace during the typical drying time for the fluid. Preferably, the fluid will evaporate under ambient conditions within a reasonable time (less than one hour). The solvent may comprise propellants if the frictive fluid is to be sprayed. Application is preferably by dropping or jetting from an orifice with pressure supplied by a squeeze tube or bottle; however, the frictive fluid may alternatively be dipped, injected, or sprayed.

In the various example described below, the following materials were used, unless otherwise noted. Polyester/cotton cord: 65% polyester and 35% cotton, round, braided, 3.2 mm diameter. Fumed silica: CAB-O-SIL®, hydrophilic, with a surface area of 175–225 square meters per gram, manufactured by Cabot Corporation, headquartered in Boston Mass.

EXAMPLE I

In this trial, a line blend of acetone (100%) and isopropanol (91% isopropanol, 9% water) was prepared, and fumed silica in the amount of 3% by weight was added to each solvent mix. For each mix, a bowknot was tied in a polyester/cotton cord wrapped around rods that were in turn mounted on a digital scale (the arrangement shown in FIG. 2), and one ml of the mix was applied to the knot and about one cm of adjoining lace. After the initial application of mix, the knots were tied and untied 5 times each, and an average taken of the breakaway force required. For each test, one end of the cord was pulled in the direction perpendicular to the scale, and the maximum force generated during the first 1 cm of slippage of the end through the knot was measured. The ratio of the average for the five tests for each mix to the average of five tests for an untreated cord (BFR) is reported below, where the percent of acetone is given. The data shows that there is an advantage to be gained by use of an acetone/isopropanol mix.

| % Acetone | BFR |
|---|---|
| 100 | 1.7 |
| 75 | 2.1 |
| 50 | 2.5 |
| 25 | 2.5 |
| 0 | 1.9 |

EXAMPLE II

A 4% suspension of Antimony oxide powder in a 25/75 acetone/isopropanol (91%) mix was prepared. The testing protocol was the same as in Example I. The BFR was found to be 1.6. This frictive powder was quite noticeable when applied to colored lace, but was barely visible on white lace.

EXAMPLE III

A 3% suspension of red iron oxide powder in the solvent of Example II was prepared. The testing protocol was the same as in Example I. The BFR was 1.9. Staining would not be acceptable for white lace.

EXAMPLE IV

A 5% suspension of magnesium carbonate powder in isopropanol (91%) was prepared. The testing protocol was the same as in Example I. The BFR was 2.5. Staining of the black lace was greater than that for fumed silica.

EXAMPLE V

The present invention may occasionally be used with other shoe care products, for instance, water repellants. In this example, the effect on the BFR of a bowknot in a polyester/cotton cord of a silicone containing spray intended for use with shoes and boots was evaluated. The spray product is CAMP DRY®, distributed by Kiwi Brands, Douglassville, Pa. One ml of a frictive fluid (FF) having 3.3% fumed silica in the solvent of Example II was applied dropwise to the knot either after or before the silicone spray.

| TEST SEQUENCE | BFR |
|---|---|
| Silicone spray only | 0.60 |
| Silicone spray/FF | 1.69 |
| FF/Silicone spray | 1.33 |

The frictive fluid increased the BFR of the knot whether used before or after the spray, while the silicone spray alone reduced the BFR substantially.

EXAMPLE VI

One ml of the frictive fluid of Example V was applied dropwise to a knot in a braided nylon filament cord, 4.6 mm in diameter, and to a knot in a braided polypropylene filament cord, also 4.6 mm in diameter. Using the testing protocol of Example I, and drying with heated air, the BFR was found to be 2.95 for the nylon cord and 3.24 for the polypropylene cord.

EXAMPLE VII

One ml of the frictive fluid containing 3.3% fumed silica in methyl ethyl ketone (MEK) was applied dropwise to a knot in a polyester/cotton cord. Using the testing protocol of Example I, the BFR was found to be 1.32.

EXAMPLE VIII

One ml of the frictive fluid containing 2.5% diatomaceous earth (DE) in acetone was applied to a knot in a polyester/cotton cord. Using the testing protocol of Example I, the BFR was found to be 1.72.

COMPARATIVE EXAMPLES

A. An adhesive spray product distributed under the name "Super 77" by 3M Adhesives Division, St. Paul Minn., was sprayed onto a bowknot in a polyester/cotton cord, and allowed to dry. The BFR, somewhat surprisingly, was reduced to 0.76.

B. A 1 ml dose of a 5% solution of polyvinyl acetate (PVA) in isopropanol (91%) was applied to a polyester/cotton bowknot. After air drying, the BFR was found to be 0.87. A 1 ml dose of a 5% solution of PVA dissolved in water (with a small amount of surfactant to aid penetration) produced a BFR of 0.96 when applied to a polyester/cotton knot and dried.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

I claim:

1. A method for increasing the Breakaway Force Ratio (BFR) of a knotted lace of an article of footwear having eyelets, comprising the steps of:

providing the article of footwear with the lace threaded through a plurality of the eyelets, whereby a first end portion and a second end portion of the lace extend from the article of footwear;

tying a knot with said first end portion and second end portion;

applying a frictive fluid to said knot, said frictive fluid comprising a volatile liquid and a powder, wherein said powder is at least partially dispersed in said volatile liquid; and drying said volatile liquid, whereafter the BFR of the knotted lace is at least 1.25.

2. A method for treating lace as recited in claim 1, wherein said knot is a bowknot.

3. A method for treating lace as recited in claim 1, wherein said knot is tightened after the step of said "applying a frictive fluid".

4. A method for treating lace as recited in claim 1, further comprising the step of shoeing a foot or foot-form with the footwear prior to the step of said tying a knot.

5. A method for treating lace as recited in claim 1, wherein the BFR of the knotted lace is at least 1.5 subsequent to the step of said drying.

6. A method for treating lace as recited in claim 1, wherein said drying comprises allowing said volatile liquid to evaporate under ambient conditions.

7. A method for treating lace as recited in claim 1, wherein said powder has an index of refraction of less than 1.7.

8. A method for treating lace as recited in claim 1, wherein said powder has an index of refraction of less than 1.5.

9. A method for treating lace as recited in claim 1, wherein said powder is substantially colorless.

10. A method for treating lace as recited in claim 8, wherein said powder is substantially colorless.

11. A method for treating lace as recited in claim 1, wherein said powder has a relative opacity of less than 10.

12. A method for treating lace as recited in claim 1, wherein said powder has a relative opacity of less than five.

13. A method for treating lace as recited in claim 1, wherein said powder has a relative opacity of less than one.

14. A method for treating lace as recited in claim 1, wherein said powder comprises an oxide or carbonate.

15. A method for treating lace as recited in claim 1, wherein said powder comprises silica.

16. A method for treating lace as recited in claim 15, wherein said silica is amorphous silica.

17. A method for treating lace as recited in claim 1, wherein said volatile liquid comprises one or more from the group consisting of ketones, alcohols, hydrocarbons, and water.

18. A method for treating lace as recited in claim 17, wherein said alcohol is isopropanol.

19. A method for treating lace as recited in claim 17, wherein said ketone is acetone.

20. A method for treating lace as recited in claim 17, wherein said powder comprises silica.

21. A method for treating lace as recited in claim 17, wherein said powder comprises colorless amorphous silica having a relative opacity of less than one.

22. A method for increasing the breakaway force ratio (BFR) of a knotted lace of an article of footwear having eyelets, comprising the steps of:

providing the article of footwear with the lace threaded through a plurality of the eyelets, whereby a first end portion and a second end portion of the lace extend from the article of footwear;

applying a fluid comprising a powder to at least said first end portion; and subsequently tying a knot in the lace so that said first end portion is at least partially within said knot, whereafter the BFR of the knot is at least 1.25.

* * * * *